United States Patent [19]

Franklin

[11] 4,256,149

[45] Mar. 17, 1981

[54] ELECTROMECHANICAL FILLING INDICATOR FOR PATTERN-CONTROLLED WEAVING LOOM

[75] Inventor: Arthur H. Franklin, Morganton, N.C.

[73] Assignee: M. Lowenstein & Sons, Inc., New York, N.Y.

[21] Appl. No.: 28,381

[22] Filed: Apr. 9, 1979

[51] Int. Cl.[3] ..... D03D 47/34

[52] U.S. Cl. ..... 139/453

[58] Field of Search ..... 139/450, 453

[56] References Cited

U.S. PATENT DOCUMENTS

| | | | |
|---|---|---|---|
| 2,814,315 | 11/1957 | Lyle et al. | 139/453 |
| 3,376,900 | 4/1968 | Payne | 139/453 |
| 3,528,460 | 9/1970 | Spearman | 139/453 |
| 3,791,418 | 2/1974 | Pfarrwaller | 139/453 |

*Primary Examiner*—Henry Jaudon

*Attorney, Agent, or Firm*—Luke J. Wilburn, Jr.; Wellington M. Manning, Jr.

[57] ABSTRACT

An improved electromechanical filling yarn indicator for use in a pattern-controlled outside filling yarn supply weaving loom to translate motion of fill yarn control cords of a jacquard harness or other pattern control mechanism into electrical signals for transmission to activating solenoids of fill yarn control box selectors which present selected fill yarns from outside filling yarn supply packages to the fill yarn carrier for insertion into the warp shed of the loom. The fill yarn indicator comprises a plurality of slidably movable bars, each having an electrical contact connected to a power supply and engageable with one of a pair of electrical contacts spaced along the path of sliding movement of the bars. Each contact of the pairs of contact is connected to a respective actuating solenoid of fill yarn control box devices located on either side of the loom. The position of each slidable bar to bring its electrical contact into communication with either one of the pairs of contacts spaced along its path of movement is controlled by a fill yarn control cord attached to each end of the bar, such that movement of the cords and bars in response to pattern information from the jacquard mechanism provides electrical signals to selected of the control box solenoids to present a desired fill yarn to the fill yarn carrier for insertion into the warp shed during weaving operations.

13 Claims, 4 Drawing Figures

ELECTROMECHANICAL FILLING INDICATOR FOR PATTERN-CONTROLLED WEAVING LOOM

The present invention relates to an improved indicator for selective filling yarn insertion into a warp yarn sheet during formation of a patterned fabric on a pattern-controlled weaving loom. More particularly, the invention comprises an improved compact electromechanical indicator consisting of a plurality of sliding bar mechanisms which are connected to and positioned by the control cords, or harness lines, of a jacquard pattern device to actuate electrical signals for selective presentation of different fill yarns to the fill yarn carrier of the loom for insertion into the warp yarn and shed during weaving operations.

BACKGROUND OF THE INVENTION

Weaving looms having patterning mechanisms have long been employed in the textile industry to selectively position warp yarns and fill yarns in the warp sheet during weaving operations to form a desired pattern in the woven fabric produced on the loom. In a jacquard pattern-controlled loom, a desired fabric pattern is recorded as a series of holes in pattern cards of the jacquard head motion. During weaving, these cards are moved past card cylinder sensing devices which activate griff racks to lift selected harness cords connected to yarn guides of the loom to move selected of the yarns in desired positions during the weaving operation.

One such jacquard pattern control loom manufactured by Crompton & Knowles of Charlotte, North Carolina is identified as an OFS (outside filling supply) loom, in which filling yarns from supply packages of yarn of different color or composition, up to four in number on either of the warp yarn sheet, are selectively supplied to the warp shed in a desired sequence controlled by the jacquard cards and harness cords to form the pattern in the woven fabric. In the outside filling supply loom, the individual filling yarns from the supply packages are guided to individual yarn gripper elements or fingers mounted on a movable support hand located adjacent each end of the path of traverse of the filling yarn carrier through the warp yarn shed. Each of the hands and their corresponding gripper fingers are mechanically moved by a series of levers, cams, and gears known in the art as a color conrol box mechanism, which is actuated by electrical signals to present a selected gripper finger and its fill yarn to the fill yarn carrier for each pick, or fill yarn, insertion into the warp shed.

The electrical signals to the control box devices on each side of the loom are initiated in accordance with fill yarn pattern information on the jacquard pattern cards. A jacquard harness control cord for each of the eight fill yarn package supply positions (four on each side of the loom) is connected by a sliding rod attachment to one of four mechanical lever arms and four corresponding latch members engagable with the other ends of the lever arms. Movement of the lever arms and retention and release by their latch members move four elongate push rods to operate four pivotable elements which respectively engage four micro-switches. The four micro-switches are in turn electrically connected to activate one or more of eight color control box solenoids, four on each control box device located on each side of the warp yarn sheet. Depending on the sequence of activation of the box solenoids, the four filling yarn gripper fingers on each support hand are selectively positioned adjacent the reciprocating fill yarn carrier to present a desired fill yarn to the carrier at each end of its passage through the warp shed. On the Crompton & Knowles OFS jacquard loom, the mechanical linkage mechanism translating movement of the control cords into electrical signals to the solenoids of the color control box devices is known as a Model 100 indicator.

In the past, difficulties have been experienced in operation and utilization of the above-described mechanical linkage indicator for transmitting harness cord motion into electrical signal information to the color control box devices of the fill yarn supply. Because of the high speed, rapid movement of the mechanical elements of the indicator, the levers, control rods, and latch components wear, become misaligned, deteriorate, and sometimes break during the controlling operation. The linkage mechanisms further are biased by springs which return them to initial positions after activation by the control cords of the jacquard head motion, and these springs often wear and break after a continued period of use. In addition, the micro-switches actuated by the mechanical rods and pivotable elements often break or electrically malfunction, all requiring frequent replacement with consequent down time and unreliability of operation of the loom.

Further, since electrical power is continuously supplied to the control box solenoids when they are activated by the micro-switches, and since the looms are often stoppped for periods of time during weaving operations to replace and repair broken yarn ends, the control box solenoids activated during such periods of loom stoppage excessively heat-up, burn out, and present an ever-present fire hazard.

GENERAL OBJECTS OF THE INVENTION

It is therefore an object of the present invention to provide a more simplified, inexpensive, and more reliable pattern control indicator for translating pattern control cord motion directly into electrical signals for operation of the control box solenoids controlling the position of the fill yarn gripper fingers of a weaving loom.

It is another object to provide an improved electromechanical indicator for translating moving cord pattern information from a loom pattern device into electrical signals for selective presentation of desired fill yarns to the fill yarn carrier of a loom for insertion into the warp yarn and shed during the weaving operation.

It is another object to provide a fill yarn control indicator for translating jacquard pattern information into electrical signals transmitted to an electricaly actuated color control box of an outside filling supply loom to selectively present fill yarns to the fill yarn carrier traversing the warp shed of the loom.

It is a further object to provide an improved weaving loom having a patterning mechanism for insertion of selected fill yarns from an outside filling supply into the fabric being produced by the loom.

BRIEF SUMMARY OF THE INVENTION

Briefly, the present invention comprises a filling yarn electromechanical indicator mechanism for use with an outside filling supply loom for translating moving cord pattern information into electrical signals for operation of the solenoids of the color control box devices of the fill yarn mechanisms. More particularly, the indicator comprises a plurality of elongate elements mounted for reciprocating, sliding movement, with opposite ends of each attached to a fill yarn control cord of a jacquard harness motion. Each of the slidable elements supports an electrical contact which is moved, by the cords, to selectively engage one of a pair of electrical contacts mounted along the path of movement of the element, such that electrical signals are selectively sent, in accordance with cord motion and card pattern information, to one or more of the activating solenoids of each fill yarn control box device. Each control box device, one of which is located on either side of the loom, controls the position of a fill yarn gripper hand having a plurality of fill yarn gripping fingers which are selectively moved to present a desired fill yarn from one of the supply packages to the fill yarn carrier for insertion into the warp yarn shed of the loom during each traverse thereof.

During the weaving operation, power is supplied to the fill yarn indicator and consequently to the control box solenoids only when the loom is in actual operation, such that power is removed from the solenoids during periods when the loom is stopped for maintenance or repair of the fabric being woven.

BRIEF DESCRIPTION OF THE DRAWINGS

The above as well as other objects of the invention will become more apparent, and the invention will be better understood, from the following detailed description of a preferred embodiment thereof, when taken together with the accompanying drawings in which.

DETAILED DESCRIPTION OF THE PREFERRED EMBODIMENT

Figure 1:
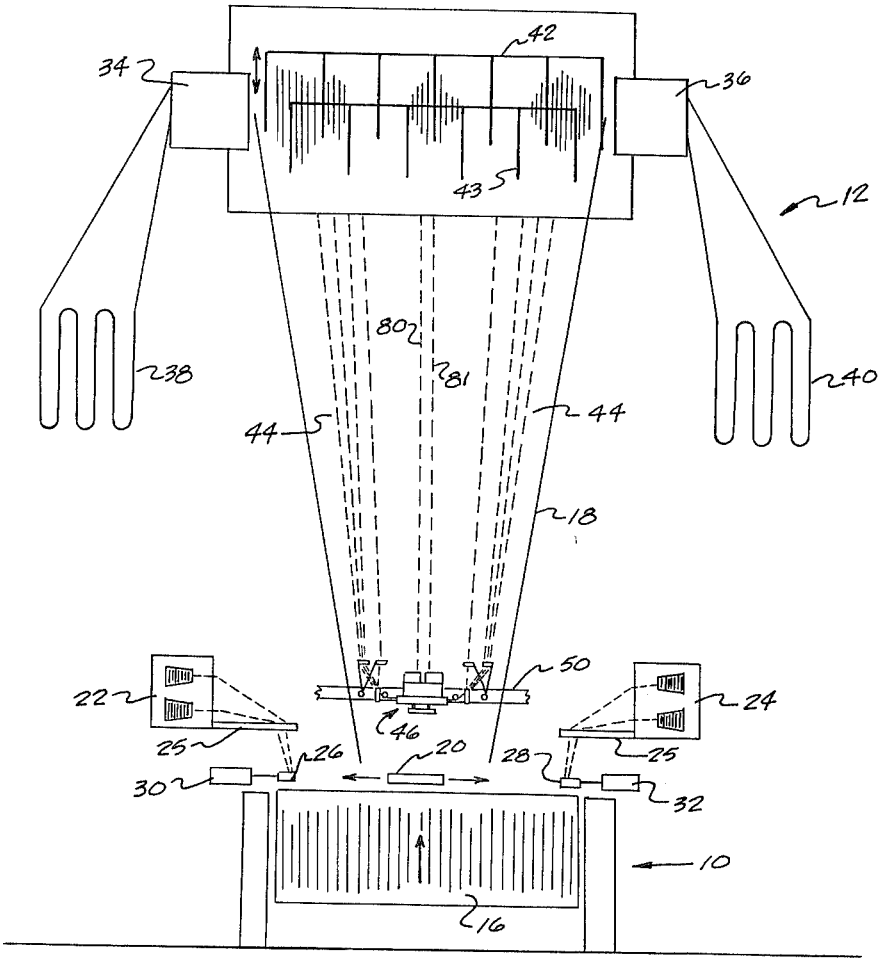
FIG. 1 is a schematic rear elevation view of an outside filling supply weaving loom employing jacquard patterning mechanism for control of the position of the warp yarns and for selection of the fill yarns to be inserted into the warp shed by the fill yarn carrier.

Referring more specifically to the drawings, FIG. 1 is a schematic rear elevation view of a textile weaving loom 10 of the outside filling yarn supply type, having a jacquard pattern mechanism 12 for transmitting pattern information to the loom to control the position of the warp yarns in forming the warp yarn shed, and for selecting the particular fill yarn for insertion into the warp yarn shed on each pick of the weaving operation. As is well known in the art, a sheet of warp yarns from a warp beam 16 are directed through warp yarn control guides (not shown) which are connected to individual control cords of the jacquard control harness 18. In accordance with pattern information, the cords raise selected warp yarns to form the warp shed for insertion of each fill yarn, or pick, by a fill yarn carrier 20 which reciprocates in known manner through the shed during the weaving operation.

Positioned on either side of the loom are a group of four fill yarn supply packages, only two of each group of which, 22, 24 are shown. Individual ends from the groups of packages 22, 24 are directed through suitable guides 25 to individual fill yarn gripper fingers (not shown) on movable gripper support hands 26, 28, respectively located on either side of the loom at each end of the path of travel of yarn carrier 20 through the warp shed. The gripper fingers on support hands 26, 28 are selectively positionable by respective fill yarn color control box devices 30, 32 located adjacent thereto. Each of the box motion devices 30, 32 includes a series of four solenoids which operate cams, gears and connecting elements to move the gripper finger hands in response to electrical signals from the jacquard pattern control to selectively present a gripper finger and its fill yarn to the fill yarn carrier at the ends of its traverse through the warp shed. The details of the mechanical arrangement and operation of the control box devices and gripper fingers and hands are well known in the art and will not be described in detail herein. Such control box devices and fill yarn gripper control mechanisms typically may be of the type employed on a Crompton & Knowles OFS loom which is commercially available in the art.

Constructional details of the fill yarn gripper control mechanisms and linkages are disclosed in Payne U.S. Pat. No. 3,376,900 assigned to Crompton & Knowles and the disclosure thereof is included herein by reference. Said patent shows and describes in detail the particular swing arm with support hand and individual fill yarn gripper finger mechanisms 26, 28 at each side portion of the loom which are respectively actuated by the fill yarn control box devices 30, 32 shown in the drawings of the present application. Motion from the control boxes 30, 32 is transmitted to the gripper hand and fingers through an output rod, identified at 343 in the drawings of U.S. Pat. No. 3,376,900, which correspondingly moves the support hand and the fill yarn gripper fingers through a sprocket and chain arrangement 65–67 as shown and described in the aforesaid patent.

U.S. Pat. No. 3,376,900 also discloses two fill yarn color control box devices (indicated by the number 300 in the patent specification and drawing), each of which employs solenoids with return springs activated by pattern control information from a pattern mechanism to present selected fill yarn gripper fingers to fill yarn carrier. The fill yarn control box devices 30, 32 of the present application each perform the same general function as those described in the aforesaid patent; however, each of the color control box devices 30, 32 herein employ four solenoids which actuate two internal eccentrics and gears of the control box to position a selected one of the four fill yarn gripper fingers to the fill yarn carrier 20. Details of the construction of the four solenoid, color control box devices 30, 32 are well known in the art and are described in Crompton and Knowles *Outside Filling Supply Loom Instruction Manual,* revision of February 1969. Such devices are commercially available from Crompton & Knowles as OFS Color Selector Parts Nos. 250240 and 250241.

The jacquard pattern control mechanism illustrated in FIG. 1 is a standard double-lift, double-cylinder type having a pair of cylinders 34, 36 with associated pattern cards 38, 40 which alternately operate two griff racks, diagrammatically illustrated at 42, 43, to raise and lower selected control cords of the jacquard harness 18. Each of the control cords from each griff is connected in known manner to yarn guides which raise and lower selected individual yarns of the warp yarn sheet to form a warp yarn shed for each pick, or fill yarn, insertion by the fill yarn carrier 20.

Also attached to each of the two griffs are four fill yarn control cords, illustrated by dashed lines 44 in FIG. 1, the lower ends of which are operatively connected to the improved fill yarn control indicator 46 of the present invention. Fill yarn indicator 46 translates pattern motion of the control cords into electrical signals to operate the solenoids of the fill yarn control box devices 30, 32 to selectively present a particular fill yarn from the outside supply packages 22, 24 to the reciprocating carrier on each pick insertion, as will be explained in detail hereinafter. The double-lift, double-cylinder jacquard control mechanisms, including associated card cylinders, pattern cards, griffs, griff racks, and control cord harness, and the operation of the same, are well known in the art and will not be discussed in detail herein.

Figure 2:
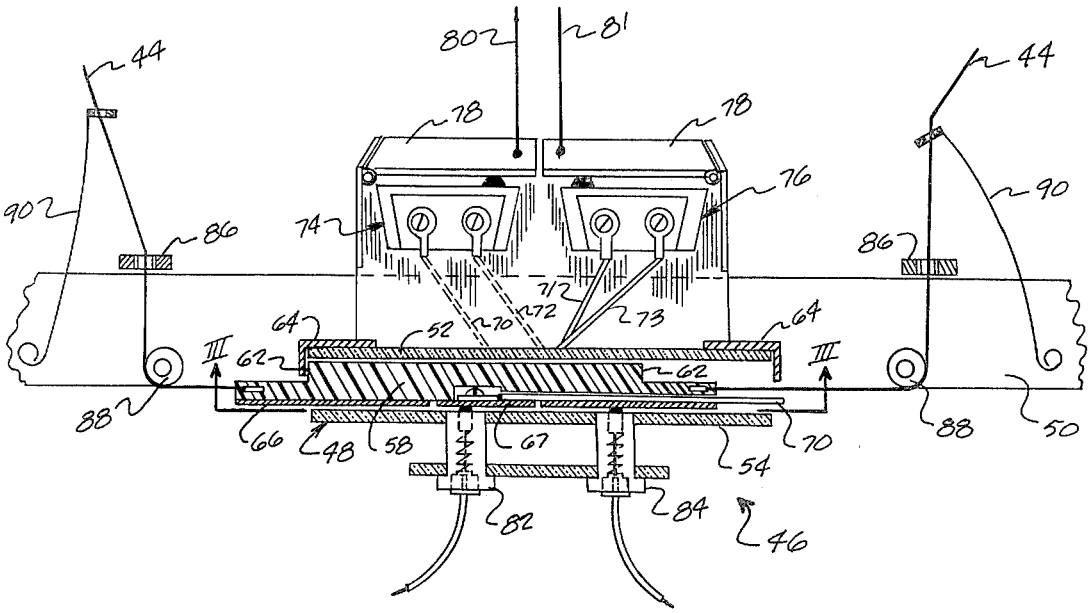
FIG. 2 is an enlarged schematic vertical sectional elevation of the improved fill yarn control indicator of the loom of FIG. 1, which is employed to translate jacquard harness cord movement into electrical signals for transmission to the fill yarn control box devices of the loom, whereby selected of the fill yarns supplied from outside fill yarn packages are presented to the fill yarn carrier during each traverse of the carrier through the warp yarn shed.
Figure 3:
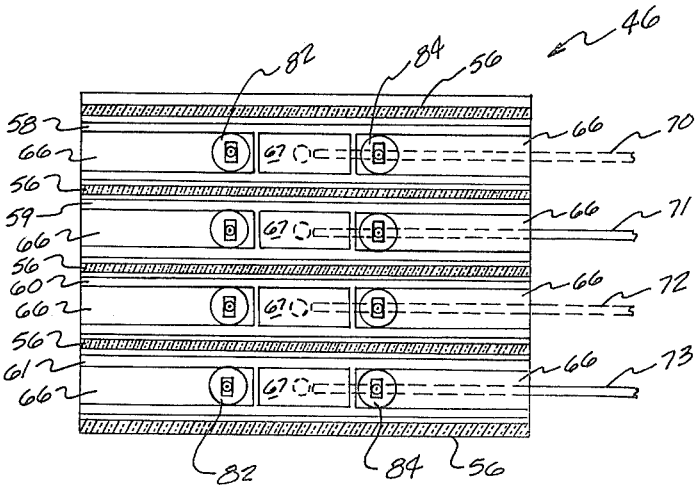
FIG. 3 is a schematic horizontal sectional view of the fill yarn indicator taken generally along line III—III of FIG. 2 but with the slidable bars of the indicator shown in an intermediate position of movement to more clearly illustrate the electrical contacts thereon.

As best seen in FIGS. 2 and 3, the fill yarn control indicator 46 of the present invention comprises a support box, or frame 48, suitably mounted by means, not shown, on a horizontal support member 50 of the loom above the middle of the warp yarn sheet. The support box 48 includes top and bottom walls 52, 54 spaced by vertical walls 56 (FIG. 3) to define four channels or pathways for sliding movement of four elongate slidable bars or elements 58–61. The walls of the box are attached by suitable means, such as screws, not shown. Each of the slidable elements is of generally rectangular shape with shoulder portions 62 which engage stop means, shown as angle iron elements 64, secured to the top wall of the box at each end of the pathways.

Suitably attached to the lower face of each slidable element, as by adhesive bonding, is a brass plate 66 which is cut and subdivided into three separate sections. The separate center section 67 of each brass plate serves as an electrical contact, and each of the center sections are connected by means of a fastening screw to an electrical wire 70–73, respectively, which extends through the main body of the slidable element and out one end thereof. Wires 70–73 are suitably connected in alternate pairs 70, 72, and 71, 73 to a pair of off-on switches 74, 76, respectively, mounted on the frame of the loom above the support box 48. Each of the switches 74, 76 is operated by means of a pivotable finger element 78 which engages and disengages an on-off button located on top of the switch. The finger elements of the control switches are attached by harness control cords 80, 81 to respective ones of the two griff racks 42, 43 of the jacquard machine, such that only when the griff racks are alternately raised to transmit pattern information, power is supplied from a suitable power supply, not shown, through the switches to the respective element contacts 67 of wires 70, 72 and 71, 73, as best seen in FIG. 3.

Figure 4:
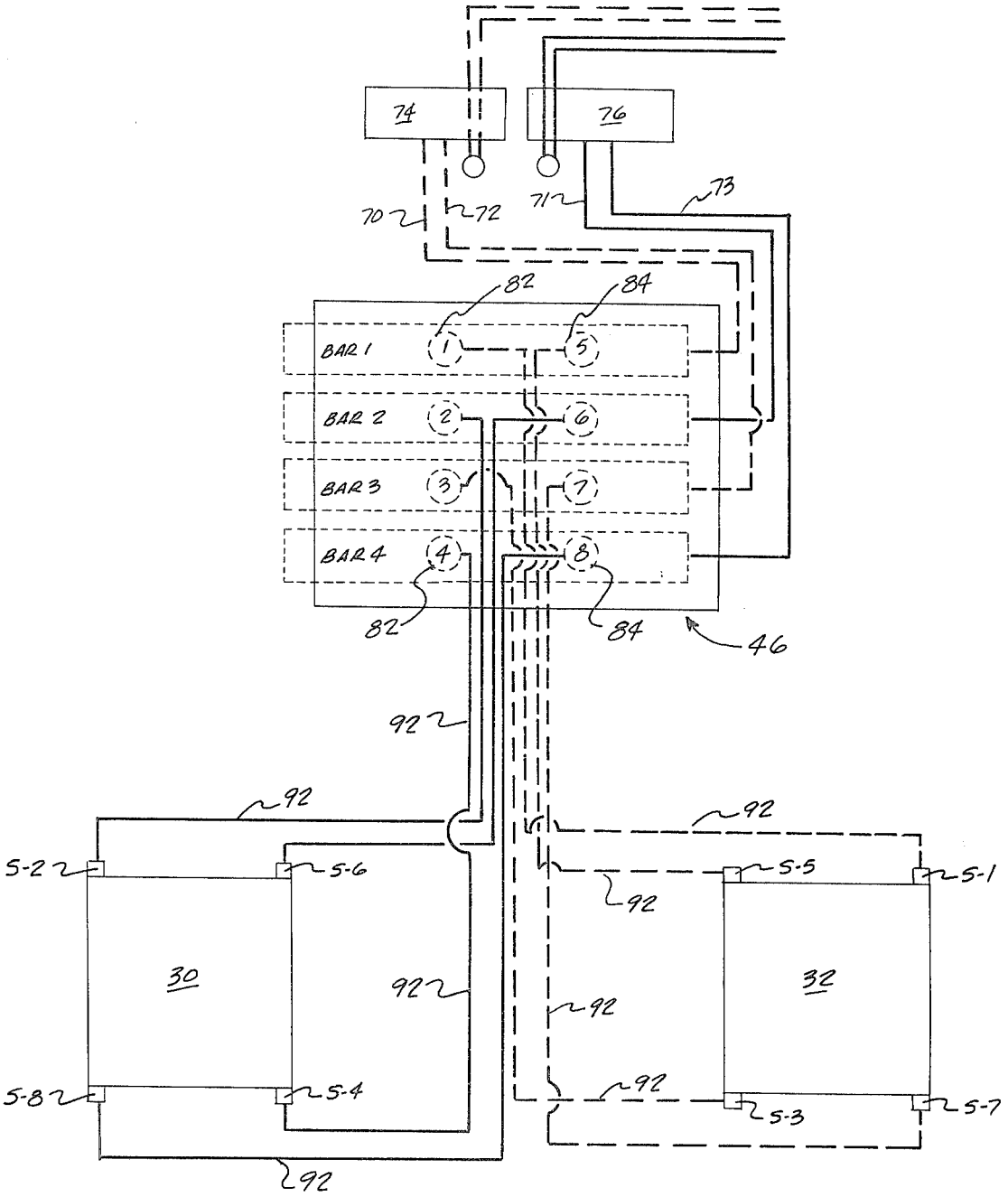
FIG. 4 is an electrical wiring diagram indicating the manner in which the indicator of FIGS. 2 and 3 receives and transmits electrical signals to operate the solenoids of the filling yarn control box devices of the loom.

As further seen in FIGS. 2 and 3, extending through the bottom wall 54 and located in spaced relation along each of the channels in which the slidable elements 58–61 move, are spaced pairs of spring-biased, electrical brush contacts 82, 84, each of which is electrically connected by a wire to a respective electrical solenoid of the two control box devices 30, 32. As seen in FIG. 4, each control box device 30, 32 has four solenoids, S-2, 4, 6, 8 and S-1, 3, 5, 7, respectively, which, upon activation, operate the gears and eccentrics of the control box assembly to correspondingly move its gripper finger hand to present a selected fill yarn to the fill yarn carrier at the beginning of its traverse through the warp shed.

As seen in FIGS. 1 and 2, attached in holes in each end of each slidable element in indicator box 48 is an individual harness control cord 44. Four of the cords attached to the ends of the slidable elements 58–61 are operated by griff rack 42, while the other four cords attached to the ends of the elements are operated by griff rack 43. Thus, the eight harness control cords serve to move the four slidable elements individually either in a left or right direction (as seen in FIG. 2) in response to cord movement indicated by the pattern on the cards 38–40. Each fill yarn cord 44 from the jacquard machine 12 passes through guide eyes 86 and about guide rollers 88 for attachment to the ends of the slidable elements 58–61. Any slack in the cord element during their movement by the griffs is removed by spring guides 90 mounted on the horizontal frame member of the loom.

Thus, it can be seen that when the griff racks 42, 43 are alternately raised in the jacquard mechanism 12 to lift selected cords in accordance with pattern information from the jacquard cards 38, 40, the selected fill yarn cords 44 will pull corresponding slidable elements of the indicator either full right or full left to bring their electrical contact 67 into selective engagement with ones of the pairs of electrical brush contacts 82 or 84. FIG. 3 illustrates the slidable elements in an intermediate position of movement to better see the electrical contacts 67 thereon.

Operation of the fill yarn indicator and its electrical connectionss to the activating solenoids of the fill yarn control box devices may best be described and explained by reference to FIG. 4, which is a schematic wiring diagram of the brush contact electrical connection to the solenoids of the control box devices 32, 34. For simplification of understanding, the four solenoids of box device 30 have been identified as S-2, 4, 6, 8, while those of box 32 have been identified as S-1, 3, 5, 7. The eight brush contacts 82, 84 are arranged in two rows and are numbered 1–8 corresponding to the particular solenoid to which it is connected by electrical wire 92. Slidable bar elements 58-61 of the indicator are identified as bars 1–4, respectively. Thus, it can be seen that slide bars 1 and 3 operate the solenoids S-1, 3, 5 and 7 of control box device 32 on the right side of the loom as seen in FIG. 1, while slide bars 2 and 4 operate the solenoids S-2, 4, 6, 8 of control box 30 on the left side of the loom.

The particular sequence of operation of the slidable elements to present selected fill yarns from the four supply package positions designated 2, 4, 6, 8 on the left hand side of the loom, and the four supply package positions, designated as 1, 3, 5, 7 on the right hand side of the loom, may be described by reference to FIGS. 4 and 5 as follows. In the particular control box devices 30, 32 shown in the schematic drawing, simultaneous activation of solenoids S-2 and 4 of control box devices 30 present a fill yarn from package supply position 2 to the carrier; S-6 and 4 present a fill yarn from supply position 4 to the carrier; S-2 and 8 present a fill yarn from supply position 6; and S-6 and 8 present a fill yarn from supply position 8 to the carrier. Similarly, in control box 32, simultaneous activation of solenoids S-1 and 3 present a fill yarn to the carrier from supply position 1; S-5 and 3 presents a fill yarn from supply position 3; S-1 and 7 presents a fill yarn from supply position 5; and S-5 and 7 presents a fill yarn from supply position 7. Thus, it can be see that when the slide bars are moved by the control cords in accordance with pattern information on the jacquard cards, they pass electrical current to the individual solenoids by way of their contacts 67 and the brush contacts with which they become engaged. The foregoing sequence of operation of the slidable elements of the indicator to selectively electrically activate pairs of solenoids of each of the fill yarn control boxes is summarized in the following table, making reference to FIG. 4 of the drawings:

| Control Box Device | Fill Yarn Package Supply Position Presented | Solenoids Energized | Indicator Bar, as per Numbers in FIG. 4 | Indicator Bar Positions | Power Supply Switch Actuated |
|---|---|---|---|---|---|
| 30 | 2 | 2 and 4 | 2, 4 | Left, Left | 76 |
| 30 | 4 | 6 and 4 | 2, 4 | Right, Left | 76 |
| 30 | 6 | 2 and 8 | 2, 4 | Left, Right | 76 |
| 30 | 8 | 6 and 8 | 2, 4 | Right, Right | 76 |
| 32 | 1 | 1 and 3 | 1, 3 | Left, Left | 74 |
| 32 | 3 | 5 and 3 | 1, 3 | Right, Left | 74 |
| 32 | 5 | 1 and 7 | 1, 3 | Left, Right | 74 |
| 32 | 7 | 5 and 7 | 1, 3 | Right, Right | 74 |

In the event that the weaving loom herein described is stopped for a period of time during the weaving operation for maintenance and/or replacement or repair of warp or fill yarns in the fabric, the griff frames 42 and 43 automatically move to a lowered position, as is conventional in the jacquard patterning mechanism. In this case, the cords 80, 81 controlling pivotable fingers of on-off switches 74, 76 lower pivotable levers 78 to cut all electrical power off to the indicator 48, thereby removing power from the control box solenoids. Thus, the solenoids do not tend to heat up and cause the potential fire hazards and burn outs heretofore experienced with the known fill yarn indicators of the prior art.

The particular wiring sequence of brush contacts to control box solenoids in FIG. 4 is illustrative of the use of the indicator with a control box device of the Crompton & Knowles OFS weaving loom utilizing a double-lift, double-cylinder jacquard patterning mechanism. However, it can be appreciated that the indicator device, in its broad concepts, may be adapted and wired to other pattern controlled looms to translate mechanical cord signals to outside fill yarn box motion devices employing electrical signal information to present selected fill yarns to the warp shed of the loom.

It can thus be seen that the above described electromechanical fill yarn indicator device is of simplified, reliable mechanical construction having much less moving parts to be manipulated by the control cords and with reduced electrical circuitry to transmit the mechanical motion of the indicator into electrical signals for actuation of the fill yarn control box devices than heretofore known in the prior art.

That which is claimed is:

1. In a weaving loom having a movable control cord pattern control mechanism for selection of fill yarns to be inserted into the warp yarn sheet of the loom during weaving operations including a reciprocating fill yarn carrier for traversing the warp yarn shed for the loom to insert fill yarns therein, fill yarn selector means positioned adjacent the path of traverse of the carrier and responsive to predetermined electrical signals to selectively present any one of a plurality of fill yarns to the carrier for insertion thereby into the warp yarn shed, fill yarn control cords movable in response to a preselected fill yarn pattern on the pattern control mechanism, and electromechanical indicator means connected to said cords for translating motion of said cords into electrical signals and for sending the signals to said fill yarn selector means to present selected ones of the plurality of fill yarns to the carrier during the weaving operation; the improvement wherein said indicator means comprises:

(a) a plurality of slidable elements corresponding in number to one-half the number of fill yarn control cords;

(b) means mounting each of said slidable elements adjacent said control cords for reciprocable sliding movement along a predetermined path of travel;

(c) an electrical contact on each of said slidable elements;

(d) means for supplying an electric current to each of said contacts;

(e) a pair of electrical contacts spaced along the path of travel of each slidable element for selective engagement by said slidable element contact;

(f) means electrically connecting each contact of said pairs of electrical contacts to said fill yarn selector means to transmit electrical signals thereto when any ones of said pairs is engaged by one of said slidable element contacts and electrical current is supplied thereto; and (g) a fill yarn control cord attached to each end of each slidable element whereby movement of selected of the control cords in response to fill yarn pattern information the pattern mechanism move the slidable elements to which they are attached so that their contacts selectively engage ones of said pairs of electrical contacts in said their paths of movement to send said electrical pattern signals to said fill yarn selector means.

2. Apparatus as defined in claim 1 wherein said fill yarn selector means comprises fill yarn control box means having activating solenoids corresponding in number to the number of said electrical contacts spaced along the paths of travel of said slidable elements; and wherein said means electrically connecting each one of said pairs of contacts to said fill yarn selector means comprises electrical wiring means connecting each one of said path electrical contacts to a corresponding one of said activating solenoids.

3. Apparatus as defined in claim 1 wherein said plurality of slidable elements each comprise a generally elongate rectangular bar, said means mounting each of said slidable elements comprises support box means positioning said rectangular bars for generally parallel, side-by-side sliding movement; and guide means for directing individual of said control cords into engagement with each end of each slidable element.

4. Apparatus as defined in claim 3 wherein said guide means for said control cords includes spring means for removing slack from said cords during their activation by the pattern control mechanism.

5. Apparatus as defined in claim 3 wherein each of said slidable bars includes electrically conductive plate means attached to one face thereof, said plate means defining said electrical contact at a mid portion of said slidable bar, and each of said pairs of electrical contacts comprise a spring-biased brush contact engaging each of said plate means during movement of said slidable bars.

6. Apparatus as defined in claim 1 wherein said means for supplying an electrical current to each of said slidable element contacts includes switch means for removing electrical current from said contacts when the weaving loom is periodically stopped for maintenance or repair.

7. Apparatus as defined in claim 6 wherein said pattern control mechanism is a jacquard mechanism including two alternately operated griffs, and means connecting said switch means to said griffs for activation in response to movement of the griffs during transmission of pattern information from the jacquard mechanism.

8. Apparatus as defined in claim 7 wherein said plurality of slidable elements comprise four in number, said control cords comprise eight in number, and wherein four of said control cords are operated by each of said griffs.

9. An improved electromechanical indicator for translating fill yarn pattern information from pattern control cord movement into electrical signals sent to the fill yarn control box means for controlling supply of selected fill yarns to the fill yarn carrier mechanism of an outside filling supply weaving loom; comprising:

(a) a plurality of movable elements, each having an electrical contact thereon, and means for supplying an electrical current to each contact;

(b) means mounting each of said elements for reciprocal movement along a predetermined path of travel;

(c) electrical contacts mounted in spaced relation along said path of movement for engagement and disengagement by the element contact;

(d) means for electrically connecting each of the path contacts to a filling yarn control box device of an outside filling supply loom; and (e) means for attaching a fill yarn control cord to each end of each movable element whereby selected cord movement causes reciprocal movement of the element to bring its contact into selective engagement with the path contacts of the indicator, thereby sending electrical signals to the control box device in response to preselected pattern information transmitted by movement of fill yarn control cords.

10. Apparatus as defined in claim 9 wherein each of said elements comprises an elongate bar, said means mounting each of said elements comprises frame means positioning said bars for reciprocating sliding movement in side-by-side parallel relation along predetermined paths of travel; and said frame means further includes stop means to limit sliding movement of each of said bars at each end of its predetermined path of travel.

11. Apparatus as defined in claim 10 wherein each of said bars includes an electrically conductive plate secured to said bar and defining at a mid-portion of the length of said bar said electrical contact thereon; and said electrical contacts mounted in spaced relation on said path of movement of each bar comprises a pair of electrical contacts spaced for selective engagement by said bar contact at each end of its path of travel along said predetermined path.

12. Apparatus as defined in claim 9 wherein said electromechanical indicator includes guide means for directing a fill yarn control cord to each end of each of said movable elements, and said guide means including spring-biased means for removing slack from the fill yarn control cords during movement of said movable elements thereby.

13. Apparatus as defined in claim 9 wherein said means for supplying an electrical current to each of said movable element contacts include switch means for supplying electrical current to said movable element contacts, and means for activating said switch means in response to cord control from a jacquard pattern device.

* * * * *

UNITED STATES PATENT AND TRADEMARK OFFICE

CERTIFICATE OF CORRECTION

PATENT NO. : 4,256,149

DATED : March 17, 1981

INVENTOR(S) : Arthur H. Franklin

It is certified that error appears in the above-identified patent and that said Letters Patent are hereby corrected as shown below:

Column 4, line 52, after "to", second occurrence, insert--the--.

Column 6, line 21, "element" should read--elements--.

Column 6, line 63, delete "devices".

Column 10, claim 12, line 34, "including" should read--includes--.

Signed and Sealed this

*Second* Day of *June 1981*

[SEAL]

*Attest:*

RENE D. TEGTMEYER

*Attesting Officer*

*Acting Commissioner of Patents and Trademarks*